US007862043B2

(12) United States Patent
Kramer

(10) Patent No.: US 7,862,043 B2
(45) Date of Patent: Jan. 4, 2011

(54) GAME ASSEMBLY EMPLOYING SPRING LOADED FABRIC HINGE

(75) Inventor: Joel Kramer, Enfield, CT (US)

(73) Assignee: Hasbro, Inc., Pawtucket, RI (US)

( * ) Notice: Subject to any disclaimer, the term of this patent is extended or adjusted under 35 U.S.C. 154(b) by 21 days.

(21) Appl. No.: 12/233,367

(22) Filed: Sep. 18, 2008

(65) Prior Publication Data

US 2009/0079132 A1 Mar. 26, 2009

Related U.S. Application Data

(60) Provisional application No. 60/974,751, filed on Sep. 24, 2007.

(51) Int. Cl.
*A63F 3/00* (2006.01)

(52) U.S. Cl. ..... 273/283; 273/285; 273/287

(58) Field of Classification Search ..... 273/283, 273/285, 287
See application file for complete search history.

(56) References Cited

U.S. PATENT DOCUMENTS

| | | | | |
|---|---|---|---|---|
| 2,053,598 | A | | 5/1936 | Blau |
| 2,327,314 | A | | 8/1943 | Mevi |
| 2,795,259 | A | * | 6/1957 | Nash ..... 150/152 |
| 3,215,468 | A | | 11/1965 | Swenson et al. |
| 3,545,761 | A | | 12/1970 | Brooks |
| 3,930,652 | A | | 1/1976 | Lapolice |
| 4,136,871 | A | | 1/1979 | Meyers et al. |
| 4,194,742 | A | | 3/1980 | Adams |
| 4,252,323 | A | | 2/1981 | Levinrad |
| 4,415,161 | A | | 11/1983 | Westell |
| D296,797 | S | | 7/1988 | Andrews |
| 4,779,874 | A | | 10/1988 | Dykstra et al. |
| 4,801,148 | A | | 1/1989 | Lamb |
| 4,887,751 | A | * | 12/1989 | Lehman ..... 224/579 |
| 5,176,436 | A | | 1/1993 | Mitchell |
| 5,490,675 | A | | 2/1996 | Persidsky et al. |
| 5,560,612 | A | | 10/1996 | Ippoliti et al. |
| D467,980 | S | | 12/2002 | Creech |
| D498,923 | S | | 11/2004 | Chang |
| D499,772 | S | | 12/2004 | Creech |

(Continued)

OTHER PUBLICATIONS

PCT/US2008/77374—International Search Report. dated Dec. 1, 2008.
PCT/US2008/77374—Written Opinion of the International Searching Authority. dated Dec. 1, 2008.
PCT/US2008/77374—Notification of Transmittal of the International Search Report and the Written Opinion of the International Searching Authority or the Declaration. Dec. 1, 2008.

*Primary Examiner*—Vishu K. Mendiratta
(74) *Attorney, Agent, or Firm*—Perry Hoffman

(57) ABSTRACT

A game assembly for housing a foldable game board which is quickly and conveniently secured to an open configuration for game play through the use of a spring loaded flexible hinge. The game assembly includes a first base portion, a second base portion capable of cooperating with the first base portion between an open and a closed configuration, and at least one hinge assembly mounted at a first end to the first base portion and at a second end to the second base portion. The hinge assembly includes a flexible strap and biasing element capable of tensioning the flexible strap to maintain the first and second base portions with respect to each other in an open configuration.

16 Claims, 7 Drawing Sheets

U.S. PATENT DOCUMENTS

| | | | |
|---|---|---|---|
| D500,095 | S | 12/2004 | Creech |
| 6,991,232 | B1 | 1/2006 | Yufa |
| D535,703 | S | 1/2007 | Creech |
| D536,039 | S | 1/2007 | Creech |
| D569,443 | S | 5/2008 | Whitney |
| 2005/0233792 | A1 | 10/2005 | Rehkemper et al. |

* cited by examiner

GAME ASSEMBLY EMPLOYING SPRING LOADED FABRIC HINGE

CROSS-REFERENCE TO RELATED APPLICATION

This application claims priority pursuant to 35 U.S.C. 119 (e) to U.S. Provisional Application No. 60/974,751, filed on Sep. 24, 2007 which is incorporated herein by reference in its entirety.

BACKGROUND OF THE INVENTION

1. Field of the Invention

The present invention relates to portable game assemblies and more particularly to a game assembly for housing a foldable game board which is quickly and conveniently secured to an open configuration for game play through the use of a spring loaded flexible hinge. The invention also relates to a method for maintaining two portions of a game assembly in an open configuration with the spring loaded flexible hinge of the present invention.

2. Background of the Invention

Many existing game assemblies include portable and/or foldable features for storing and transporting a assembly. Some known game assemblies are "pocket" sized, and/or include foldable game boards which may or may not include compartments for easy storage of game pieces and transporting of the game assembly.

Game assemblies which fold for storage or transport are known to include game boards which bend or fold upon themselves one or more times, or alternatively, game boards with are made up of two separate boards hinged together. A separate storage case may also be included to contain the folded game board and/or any included game pieces.

The known game assemblies having two separate game boards coupled together employ one or more hinges coupled to each of the boards which in turn may form a box when positioned in a closed configuration. The hinges are shown to include a solid foldable material coupled to each of the two game boards in a manner such that there are either no gaps or only a small narrow gap between the two halves of the game board when unfolded to an open configuration to reveal a game playing surface. Alternatively, the hinges are also shown to include a folded material such as plastic which may be molded, if desired.

Significantly, known game assemblies do not include two base portions in cooperation with a flexible hinge assembly and biasing element. Known game assemblies do not include a spring loaded flexible hinge assembly in cooperation with two base portions, or two game boards, capable of tensioning the flexible hinge assembly to maintain the two base portions, or two game boards, in an open configuration for game play. It would be desirable to provide spring loaded flexible hinge assemblies to cooperate with base portions or game board portions for housing a foldable game which is quickly and conveniently secured to an open configuration for game play.

SUMMARY OF THE INVENTION

The present invention addresses shortcomings of the prior art to provide a game assembly for housing a foldable game board which is quickly and conveniently secured to an open configuration for game play. A spring loaded flexible hinge cooperates with two base portions and maintains the base portions in an open configuration for game play.

In one embodiment of the invention, a game assembly includes first and second base portions capable of cooperating between an open and closed configuration. At least one hinge assembly is mounted at a first end to the first base portion and at a second end to the second base portion and includes a flexible strap and biasing element capable of tensioning the flexible strap to maintain the first and second base portions with respect to each other in an open configuration.

In another embodiment of the invention, the flexible strap includes a fabric strap, and in another embodiment the biasing element includes at least one extension spring secured to one or more of a first and second end of the fabric strap. In another embodiment, the hinge assembly further includes a first hinge bracket secured to the first base portion and a second hinge bracket secured to the second base portion, and the fabric strap secured at the first end to the first bracket and at the second to the second bracket allowing the base portions to pivot between and maintain open and closed configurations.

In yet another embodiment of the invention, a game surface is included and capable of coupling to at least one of the first and second base portions for game play when the base portions are in an open configuration and storing within the base portions when in a closed configuration. In another embodiment, the game surface includes a first game board coupled to the first base portion and a second game board coupled to the second base portion.

In still another embodiment, one or more wheels are secured to at least one of the first or second base portions and capable of rolling the base portions along a surface while in an open configuration. In another embodiment, one or more storage trays are included and slidable within at least one of the first and second base portions, and in still yet another embodiment, the first and second base portions plastic a plastic material.

In one embodiment of the invention, a hinge assembly for pivotably securing together two parts of an article include a first hinge bracket coupled to a first part of an article, a second hinge bracket coupled to a second part of the article, and a flexible strap secured to the first and second hinge brackets. Further included is a biasing element capable of tensioning the flexible strap to pivotably maintain together the first and second article parts.

In another embodiment of the invention, the flexible strap includes a fabric strap, in another embodiment, the biasing element further includes an extension spring coupled to the fabric strap at one or more of the first and second hinge brackets, and in still another embodiment, the extension spring tensions the fabric strap to facilitate the cooperation of the first and second parts to pivot between open and closed positions.

In another embodiment, a method for maintaining two portions of a game assembly in an open configuration includes providing a first base portion and a second base portion capable of cooperating with the first base portion between an open and a closed configuration, and mounting at least one hinge assembly at a first end to the first base portion and at a second end to the second base portion. Providing a biasing element capable of tensioning a flexible strap of the hinge assembly maintains the first and second base portions with respect to each other in an open configuration.

In another embodiment, the flexible strap further includes a fabric strap, in another embodiment, the biasing element further includes at least one extension spring secured to one or more of a first and second end of the fabric strap, and in still another embodiment, the hinge assembly further includes a first hinge bracket secured to the first base portion and a second hinge bracket secured to the second base portion. In yet another embodiment, the first end of the fabric strap is secured to the first bracket and the second end of the fabric strap is secured to the second bracket.

In still yet another embodiment, the method further includes providing a game surface capable of coupling to at least one of the first and second base portions for game play when the base portions are in an open configuration. In another embodiment, the method further includes providing one or more wheels coupled to at least one of the first or second base portions and capable of rolling the base portions along a surface while in an open configuration.

BRIEF DESCRIPTION OF THE DRAWINGS

For the purpose of facilitating an understanding of the inventions, the accompanying drawings and description illustrate a preferred embodiment thereof, from which the inventions, structure, construction and operation, and many related advantages may be readily understood and appreciated.

DESCRIPTION OF THE PREFERRED EMBODIMENTS

Figure 1A:
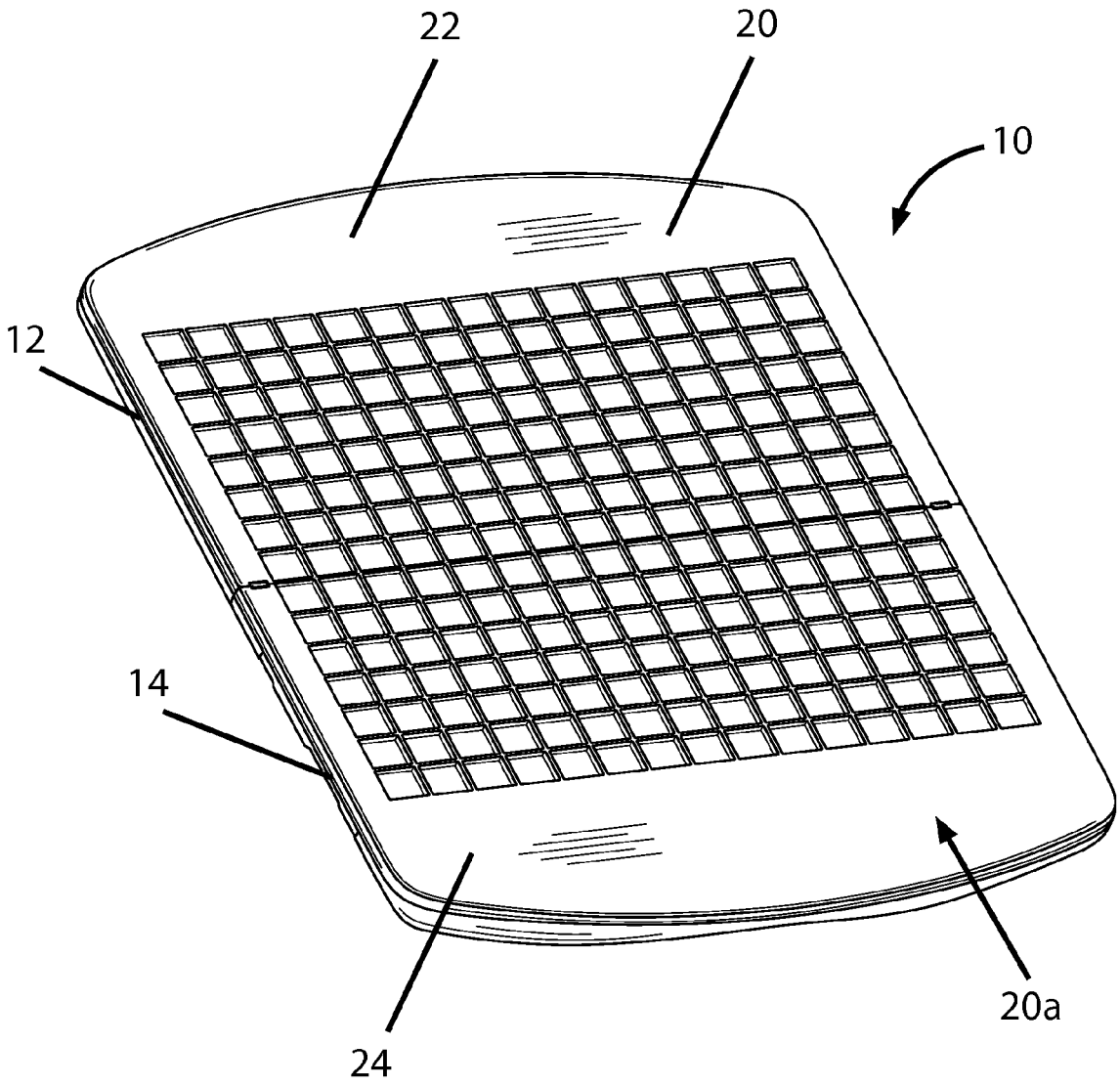
FIG. 1A is a perspective view of a game assembly of the present invention shown secured in an open configuration and illustrating a game surface, with FIG. 1B showing the game assembly of the present invention in a closed configuration.
Figure 1B:
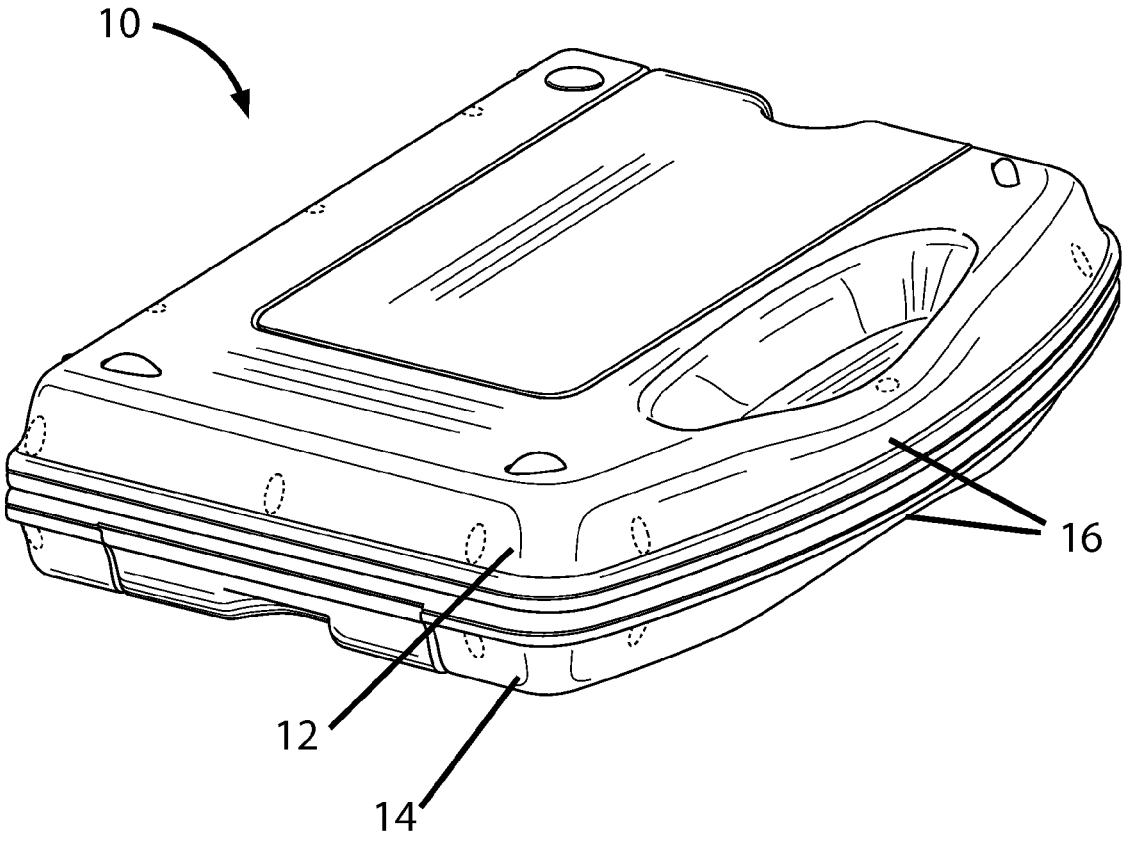

A game assembly 10, as seen in FIG. 1A, is secured in an open configuration exposing a continuous game board surface for game play and, as seen in FIG. 1B, is foldable to a closed position for easy and convenient storing and transporting of the game assembly. The game assembly 10, includes a first base portion 12 capable of cooperating with a second base portion 14, to fold and unfold with respect to each other between open and closed configurations as seen in FIGS. 1A and 1B for housing the foldable game board for quickly and conveniently being secured to its open configuration for game play through the use of e.g. a spring loaded flexible hinge. At least one hinge assembly is mounted at a first end to the first base portion and at a second end to the second base portion. The hinge assembly may include a flexible strap and biasing element capable of tensioning the flexible strap to maintain the first and second base portions with respect to each other in an open configuration. In the present described embodiment, as seen in FIG. 1B, a built in handle 16 for easy transporting of the game assembly is integral with first and second base portions 12 & 14, respectively, however, a variety of attached or integral handles for easy carrying and transporting of the game assembly 10 can be included.

The first and second base portions, 12 & 14, respectively, can include a variety of materials such as plastic, metal, etc. shaped or molded generally into two halves, about the same size, however one portion may be longer or wider than the other, and hinged together to open and close as described above. In the present described embodiment, base portions 12 & 14 are molded from plastic to generally the same size and shape and hinged together with at least one hinge assembly 18, as seen in FIG. 2.

A game board 20 cooperates with base portions 12 & 14, as seen in FIG. 1A providing a game surface 20*a* capable of coupling to at least one of the first and second base portions for game play when the base portions are in an open configuration and storing within the base portions when in a closed configuration. In the present described embodiment the game board 20 includes first and second game boards 22 & 24, respectively, hinged together and affixed to base portions 12 & 14, respectively. Boards 22 & 24 fold with respect to each other for storing within base portions 12 & 14, as seen in FIG. 1B, and for providing game surface 20*a* when unfolded and secured in an open configuration, as seen in FIG. 1A. It is also contemplated that game board 20 includes one bendable board foldable upon itself, or alternatively, multiple boards coupled together and foldable for storage in the game assembly 10 when in a closed configuration. The game board or boards may be coupled to base portions 12 & 14 or removable and fit to cooperate with base portions 12 & 14 to provide the game surface 20*a*.

Figure 2:
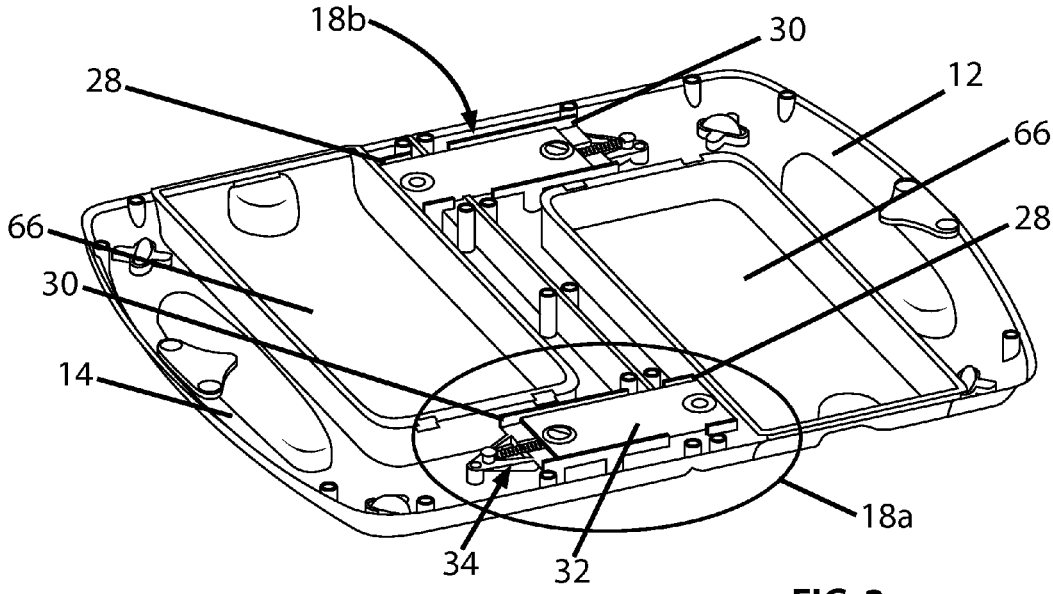
FIG. 2 is a perspective view of the game assembly with game boards removed, illustrating a flexible hinge assembly and slidable storage trays secured to each of a first and second base portion.

Base portions 12 and 14, as seen in FIG. 2, cooperate with at least one hinge assembly 18 for securing the game assembly in an open configuration and also folding to a closed configuration with respect to each other, as described above. In the present described embodiment, two hinge assemblies 18*a* and 18*b* are provided, disposed apart and oriented in reverse direction with respect to each other as the hinges are secured to base portions 12 & 14, as seen in FIG. 2. In the present described embodiment, a first end 28 of hinge assembly 18*a* mounts to first base portion 12, and a second end 30 of hinge assembly 18*a* mounts to base portion 14. Additionally, a first end 28 of hinge assembly 18*b* mounts to second base portion 14, and a second end 30 of hinge assembly 18*b* mounts to first base portion 12. It is also contemplated that two or more hinge assemblies 18 can be included and orientated in the same or reverse direction with respect to each other.

Figure 3:
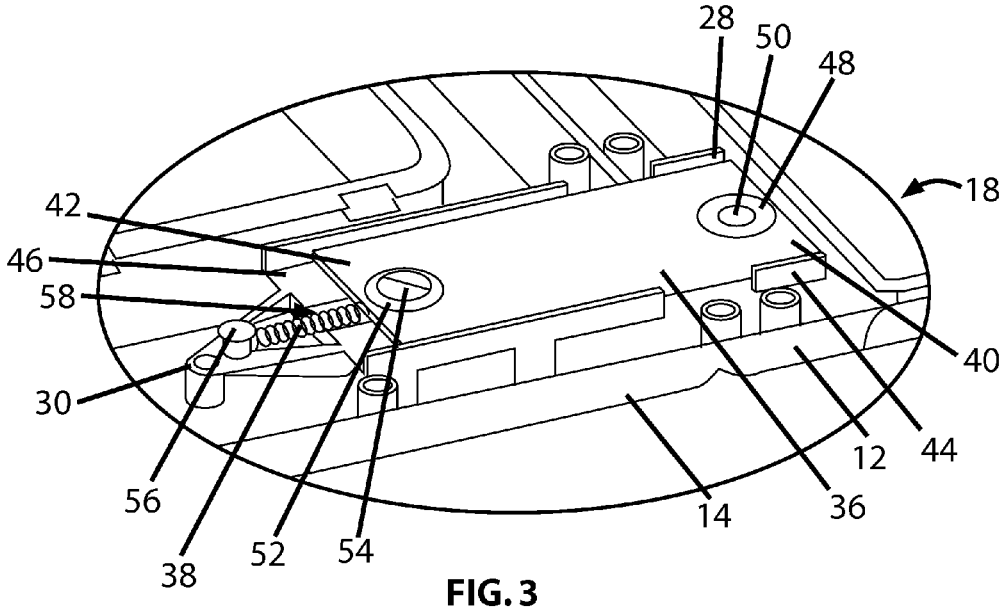
FIG. 3 is an enlarged view of the flexible hinge assembly.

The hinge assembly 18, as seen in FIGS. 2 & 3, includes a flexible strap or hinge 32 and a biasing element 34 capable of tensioning the flexible strap 32 to maintain the first and second base portions with respect to each other in an open configuration. The flexible strap 32 can include a number of elastomeric materials and/or fabric webbing, and in the present described embodiment, the flexible strap 32 includes a woven nylon fabric strap 36, and the biasing element 34 includes at least one extension spring 38 secured to one or more of a first end 40 and a second end 42 of the fabric strap 36, as seen in FIG. 3. The biasing extension spring 38 enables the fabric strap 36 to be resiliently extended as needed to open and close the game assembly 10 yet still provides enough tension to lock base portions 12 & 14 in place. Additionally, when secured in an open configuration, no separation is present between base portions 12 & 14, and when folded to a closed configuration, a user's fingers will not be pinched by the fabric strap 36.

The spring loaded fabric strap 36 is secured to base portions 12 & 14 by first and second hinge brackets 44 & 46, respectively. As seen in FIG. 3, the first end 40 of the fabric strap 36 is secured to the first bracket 44, and the second end 42 of strap 36 is secured to the second hinge bracket 46. In the present described embodiment, first end 40 of strap 36 is pierced with a grommet 48 which is secured to a post 50 of first bracket 44. Similarly, second end 42 of strap 36 is pierced with a grommet 52 which is secured to spring 38 by a screw 54. Spring 38 is secured at an opposite end from screw 54 to a post 56 which is affixed or integral with second bracket 46. First end 40 is fixed and second end 42 can stretch along second bracket 46 providing the flexible tensioning that allows base portions 12 & 14 to be pulled apart from each other to open and close the game assembly 10. Second bracket 46 includes a slot 58 which contains screw 54 and allows strap 36 to stretch only to the point where screw 54 contacts a back of slot 58, preventing the over stretching and damaging of fabric strap 36.

As seen in FIG. 3, illustrating hinge assembly 18*a*, first bracket 44 is coupled to first base portion 12, and second bracket 46 is coupled to second base portion 14. In the present described embodiment, as discussed above, hinge assembly 18*b* is oriented in reverse direction with respect to hinge 18*a*, such that first bracket 44 is coupled to second base portion 14 and second bracket 46 is coupled to first base portion 12, as seen in FIG. 2.

Figure 4A:
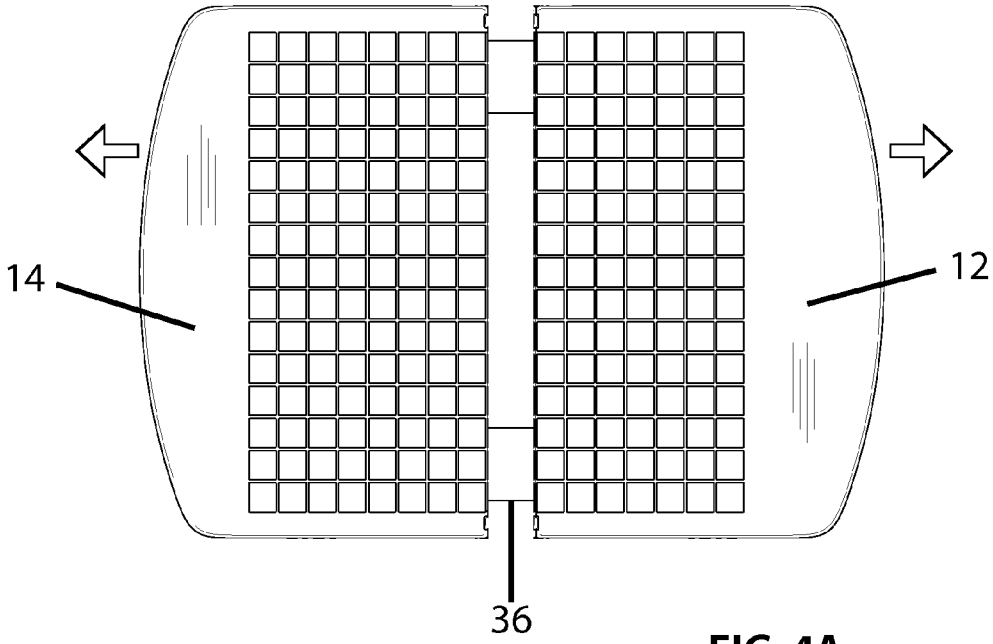
FIG. 4A is a top view of the game assembly illustrating first and second base portions subjected to opposed pulling forces separating base portions from one another and exposing the flexible hinge assembly, with FIG. 4B illustrating the first and second base portions secured in an open configuration for game play when the opposed pulling forces are released.
Figure 4B:
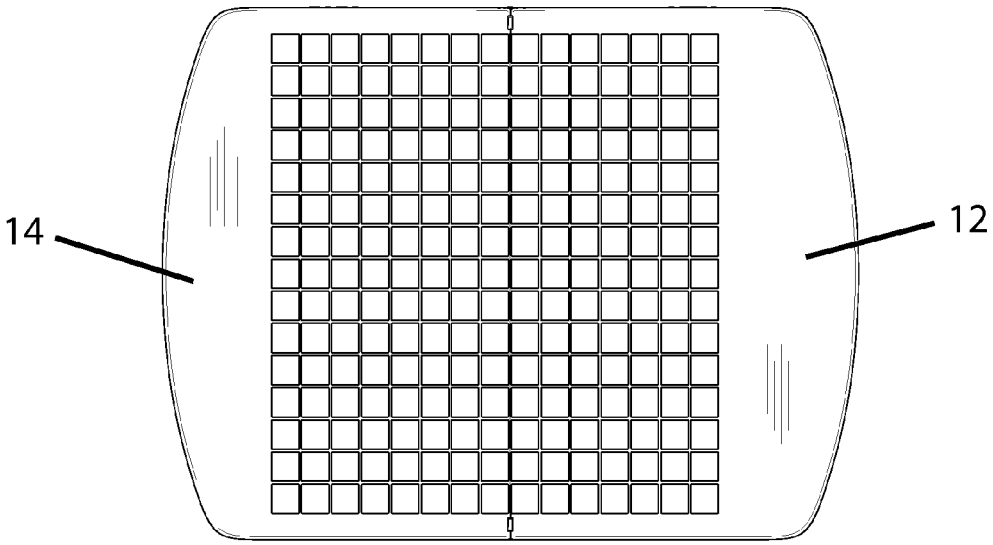

In the present described embodiment, as seen in FIGS. 4A & 4B, opposed pulling forces applied to base portions 12 & 14, pull apart the base portions and expose the fabric strap 36. Maximum separation of base portions 12 & 14 is limited generally to about ½ inch-1 inch which is sufficient to allow for the flexibility needed to open and close the base portions with respect to each other while at the same time preventing the over stretching and damaging of strap 36. When opposed pulling forces are removed and the base portions 12 & 14 are in an open configuration, as seen in FIG. 4A, extension spring 38 provides enough tension on strap 36 to secure together base portions 12 & 14 without any gaps existing there between.

Figure 5:
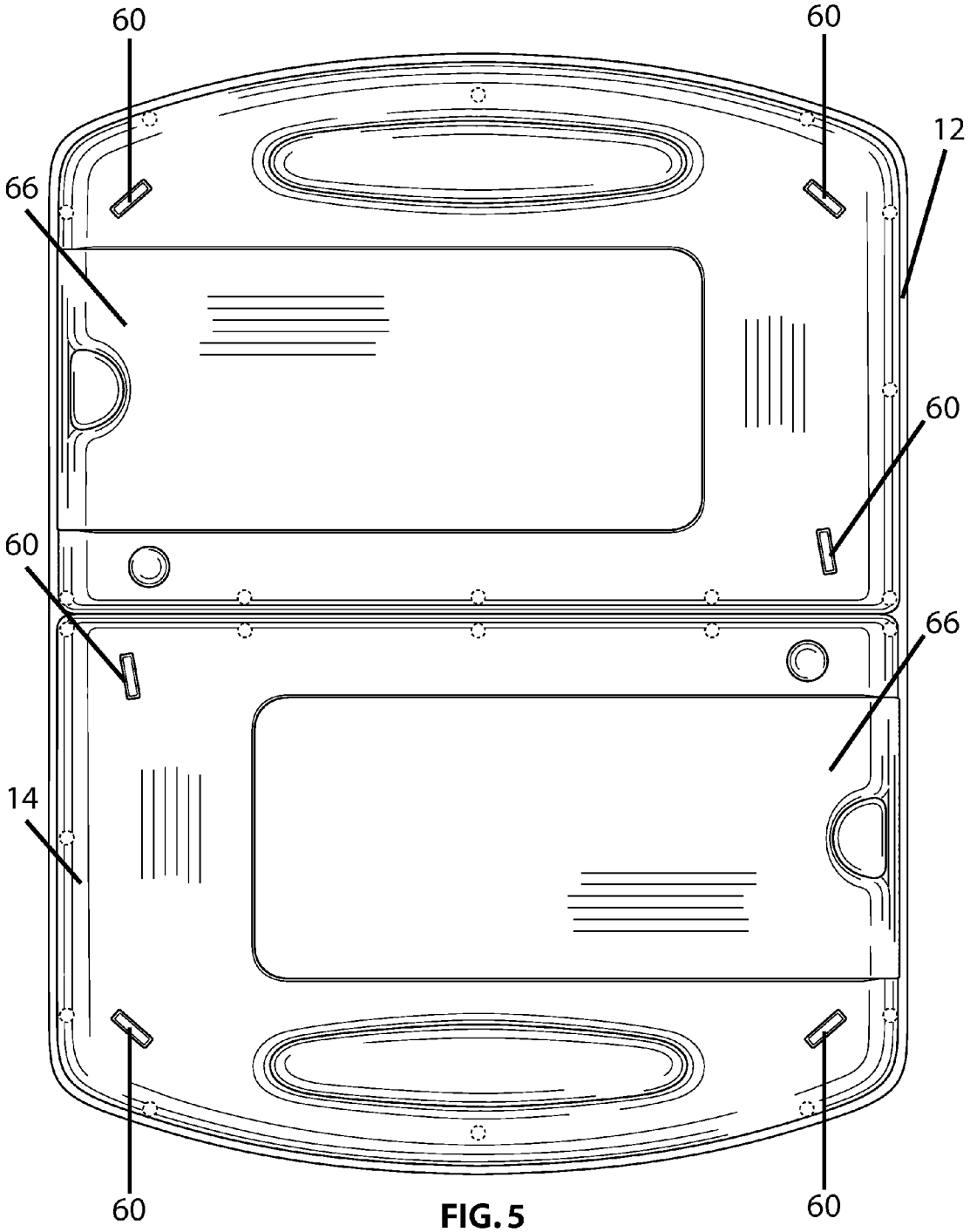
FIG. 5 is a bottom view of the game assembly illustrating wheels secured to the first and second base portions.
Figure 7:
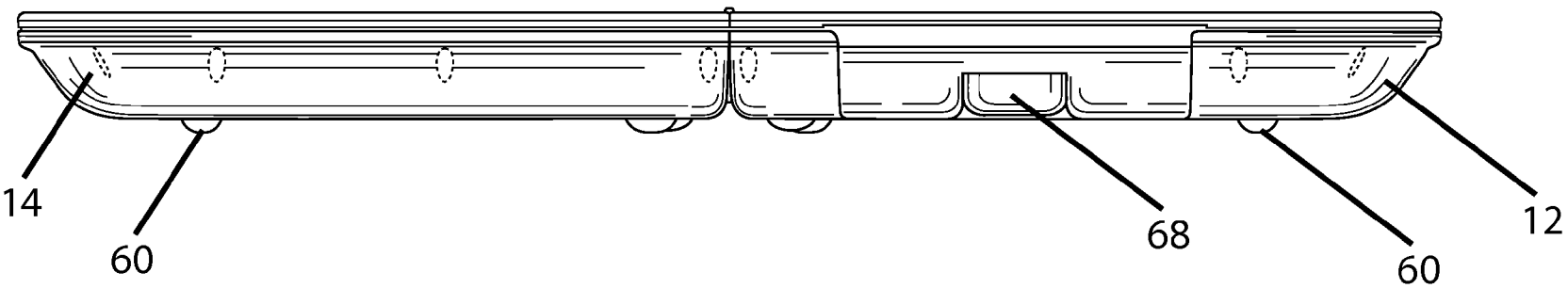
FIG. 7 is a side view of the game assembly illustrating access to the storage tray.

Additionally, one or more wheels 60 may be secured to at least one of the first or second base portions 12 & 14, respectively, and capable of rolling the base portions along a surface while in an open configuration, as seen in FIGS. 5 & 7. The wheels 60 allow the game assembly 10 to rotate about its' center when in an open configuration, acting as a turntable for the game surface 20*a* and facilitating game play. In the present described embodiment, three wheels are coupled to each base portion 12 & 14, on a side opposite game boards 22 & 24, respectively, as seen in FIG. 5.

Figure 6:
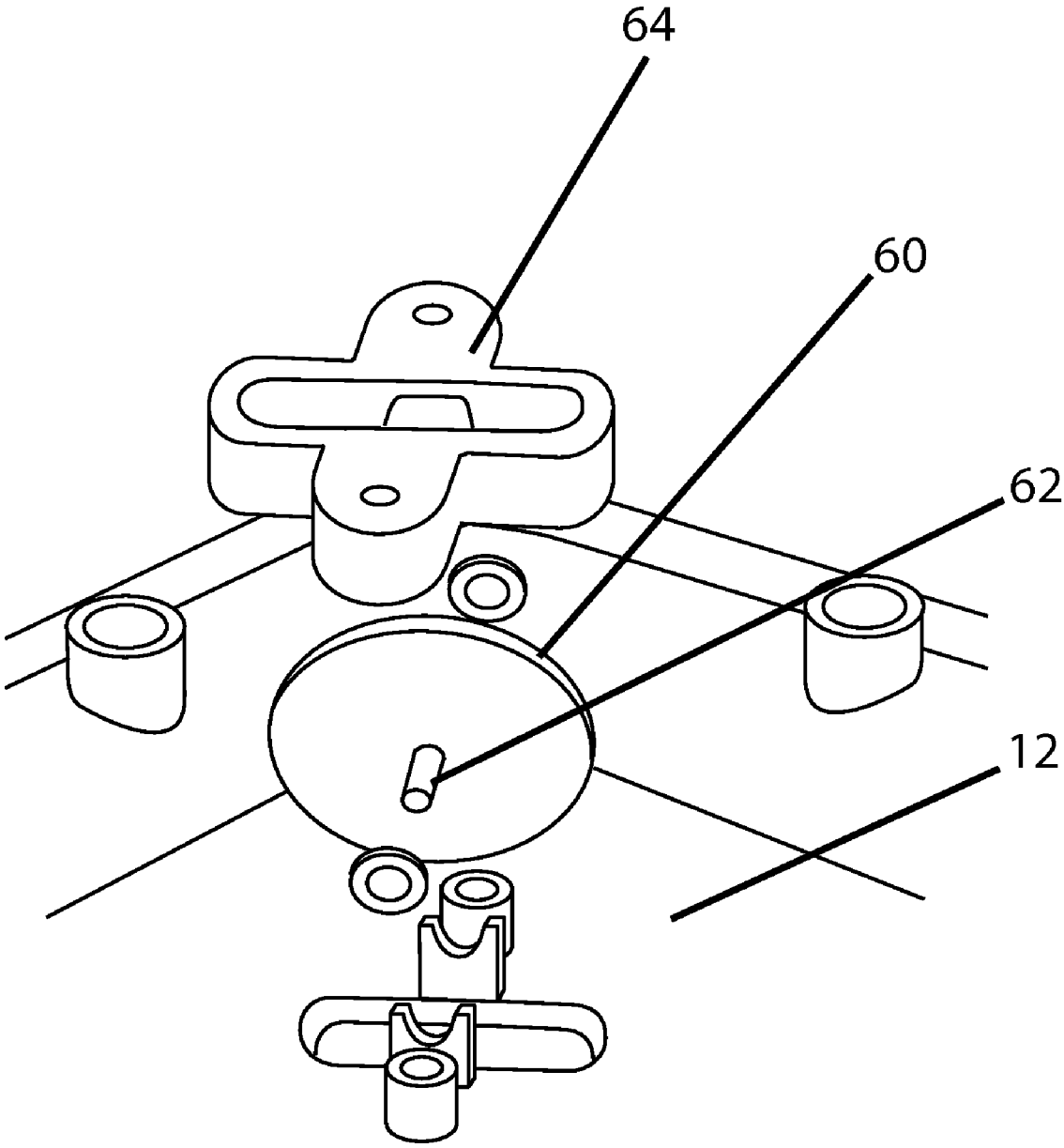
FIG. 6 illustrates a wheel assembly for securing to the first and second base portions.

In the present described embodiment, wheels 60 are relatively small and can include a number of durable materials such as Kraton, Santoprene, or Teflon, mounted to a steel axle 62 and coupled to base portions 12 & 14, as seen in FIG. 6. A wheel retainer 64 secures wheel 60 in place on base portions 12 & 14. It is also contemplated that larger wheels and an axle made from other durable materials such as plastic can alternatively be included.

Additionally, one or more storage trays 66 are slidable within at least one of the first and second base portions, 12 & 14, respectively, as seen in FIGS. 2, 5 & 7, to hold game pieces from a variety a board games playable on game surface 20*a*. In the present described embodiment, a plastic molded storage tray 66 is included in each base portion, 12 & 14, and can be accessed easily from either of two sides of the game assembly 10, by an integral handle 68, as seen in FIG. 7.

The hinge assembly 18 for pivotably securing together two parts of an article can couple boards 22 & 24 together without utilizing any base portions as described above. Instead, at least one spring loaded flexible hinge 18 is coupled to game boards 22 & 24 to fold and unfold game boards 22 & 24 with respect to each other between open and closed configurations, in a similar manner as is described above as relating to base portions 12 & 14.

In the present described embodiment, the hinge assembly 18, includes a first hinge bracket coupled to a first part of an article, a second hinge bracket coupled to a second part of the article, a flexible strap secured to the first and second hinge brackets, and a biasing element capable of tensioning the flexible strap to pivotably maintain together the first and second article parts. The flexible strap can include a fabric strap and the biasing element can included an extension spring secured to one or more of a first and second end of the fabric strap, wherein the spring tensions the strap to facilitate the cooperation of the first and second parts to pivot between open and closed positions.

In an alternate described embodiment, the game boards 22 & 24 are integral with base portions 12 & 14, and the hinge assembly further includes a first hinge bracket secured to the first base portion and a second hinge bracket secured to the second base portion.

An additional alternate described embodiment provides the foldable game board using the spring loaded fabric hinge assemblies and an alignment, registration, locking, or snap engagement assembly, e.g., of a molded polypropylene strip or the like which may further secure the two halves of the base together in the open position creating a continuous game board surface. The extruded polypropylene strip is attached to one half of the base. When the board assembly is hinged to an open position, the two halves can be pushed together to cause the polypropylene strip to snap into engagement with the opposite half of the base to retain the base in an assembled position. When the polypropylene strip is snapped into engagement in this manner the two halves of the board meet to form a continuous game surface.

A method for maintaining two portions of a game assembly in an open configuration includes the steps of providing a first base portion, a second base portion capable of cooperating with the first base portion between an open and a closed configuration, and mounting at least one hinge assembly at a first end to the first base portion and at a second end to the second base portion. A biasing element capable of tensioning a flexible strap of the hinge assembly to maintain the first and second base portions with respect to each other in an open configuration is further provided. In a present described method, the flexible strap includes a fabric strap and the biasing element includes at least one extension spring secured to one or more of a first and second end of the fabric strap.

The method further includes providing a hinge assembly with a first hinge bracket secured to the first base portion and a second hinge bracket secured to the second base portion, and the first end of the fabric strap secured to the first bracket and the second end of the fabric strap secured to the second bracket. The method further includes providing a game surface capable of coupling to at least one of the first and second base portions for game play when the base portions are in an open configuration, and providing one or more wheels coupled to at least one of the first or second base portions capable of rolling the base portions along a surface while in an open configuration.

It should be appreciated that a wide range of changes and modifications may be made to the embodiments of the inventions as described herein. It is intended that the foregoing detailed description be regarded as illustrative rather than limiting. While there have been illustrated and described particular embodiments of the inventions, it will be appreciated that numerous changes and modifications will occur to those skilled in the art, and it is intended in the appended claims to cover those changes and modifications which fall within the true spirit and scope of the present invention.

What is claimed is:

1. A game assembly, comprising:

a first base portion;

a second base portion capable of cooperating with the first base portion between an open and a closed configuration;

a game surface at the first and second base portions for game play when the base portions are in the open configuration and storing within the base portions when in the closed configuration, wherein the game surface comprises a first game board coupled to the first base portion and a second game board coupled to the second base portion; and a plurality of hinge assemblies, each said hinge assembly mounted at a first end to the first base portion and at a second end to the second base portion, each said hinge assembly comprising a flexible strap and biasing element capable of tensioning the flexible strap to maintain the first and second base portions with respect to each other in an open configuration wherein said biasing element includes at least one spring secured to one or more of a first and second end of the flexible strap, each said hinge assembly further comprising a first hinge bracket secured to the first base portion and a second hinge bracket secured to the second base portion, with the flexible strap secured at the first end to the first bracket and at the second end to the second bracket allowing the base portions to pivot between and maintain open and closed configurations.

2. The game assembly according to claim 1, wherein the flexible strap comprises a fabric strap.

3. The game assembly according to claim 1, further comprising one or more storage trays slidable within at least one of the first and second base portions.

4. The game assembly according to claim 1, further comprising one or more wheels secured to at least one of the first or second base portions and capable of rolling the base portions along a surface while in an open configuration.

5. A game assembly, comprising:

a first hinge bracket coupled to a first base portion;

a second hinge bracket coupled to a second base portion;

a first flexible strap secured to the first and second hinge brackets;

a third hinge bracket coupled to a first base portion;

a fourth hinge bracket coupled to a second base portion;

a second flexible strap secured to the third and fourth hinge brackets;

a first biasing element having a spring for tensioning the first flexible strap to maintain together the first base portion and the second base portion;

a second biasing element having a spring for tensioning the second flexible strap to maintain together the first base portion and the second base portion; and a game surface at the first base portion and at the second base portion.

6. The game assembly according to claim 5, wherein the first flexible strap comprises a fabric strap.

7. The game assembly according to claim 6, wherein the first biasing element further comprises an extension spring coupled to the fabric strap at one or more of the first and second hinge brackets.

8. The game assembly according to claim 7, wherein the extension spring tensions the fabric strap allowing the first base portion and the second base portion to pivot.

9. The game assembly according to claim 7, wherein the extension spring tensions the fabric strap to facilitate the cooperation of the first base portion and the second base portion to pivot between open and closed positions and to pivotably maintain together the first base portion and the second base portion for game play when the base portions are in the open configuration and storing within the base portions when in the closed configuration, wherein the game surface comprises a first game board coupled to the first base portion and a second game board coupled to the second base portion.

10. The game assembly according to claim 9, wherein the second flexible strap comprises a fabric strap.

11. The game assembly according to claim 9, further comprising one or more wheels secured to at least one of the first or second base portions and capable of rolling the base portions along a surface while in an open configuration, wherein the game surface comprises a first game board coupled to the first base portion and a second game board coupled to the second base portion.

12. A game assembly, comprising:

a first base portion;

a second base portion arranged to cooperate with the first base portion between an open and a closed configuration;

a game surface at the first and second base portions for game play when the base portions are in the open configuration and storing within the base portions when in the closed configuration, wherein the game surface comprises a first game board coupled to the first base portion and a second game board coupled to the second base portion;

a first hinge assembly mounted at a first end to the first base portion and at a second end to the second base portion;

a first biasing element;

a first flexible strap coupled between the first base portion and the second base portion at the first hinge assembly with the first biasing element arranged to tension the first flexible strap;

a second hinge assembly mounted at a first end to the first base portion and at a second end to the second base portion;

a second biasing element; and a second flexible strap coupled between the first base portion and the second base portion at the second hinge assembly with the second biasing element arranged to tension the second flexible strap, said first flexible strap and said second flexible strap arranged to secure the first and second base portions with respect to each other.

13. The game assembly according to claim 12, wherein the first biasing element comprises a first spring and wherein the second biasing element comprises a second spring.

14. The game assembly according to claim 12, wherein the first hinge assembly further comprises a first hinge bracket secured to the first base portion and a second hinge bracket secured to the second base portion, with the first flexible strap secured with the first hinge bracket and the second hinge bracket to enable the first and second base portions to pivot between the open and the closed configurations.

15. The game assembly according to claim 12, further comprising a first storage tray in the first base portion.

16. The game assembly according to claim 12, further comprising one or more wheels secured to at least one of the first or second base portions and arranged for rolling said base portions along a surface while in the open configuration.

* * * * *